US005094093A

United States Patent [19]

Ben-Asher

[11] Patent Number: 5,094,093

[45] Date of Patent: Mar. 10, 1992

[54] ELECTRONIC LOCK

[76] Inventor: Eldad Ben-Asher, Shderot Bialik 23, Ramat Hasharon 47206, Israel

[21] Appl. No.: 476,616

[22] Filed: Feb. 7, 1990

[51] Int. Cl.[5] ..... E05B 47/00

[52] U.S. Cl. ..... 70/278; 70/215

[58] Field of Search ..... 70/379 R, 380, 215, 70/216, 217, 277, 27 B

[56] References Cited

U.S. PATENT DOCUMENTS

| | | | |
|---|---|---|---|
| 3,995,460 | 12/1976 | Sedley | 70/210 |
| 4,603,564 | 8/1986 | Kleinhany | 70/277 |
| 4,761,976 | 8/1988 | Kleinhany | 70/277 |
| 4,901,545 | 2/1990 | Bacon | 70/278 |

*Primary Examiner*—Robert L. Wolfe
*Attorney, Agent, or Firm*—Helgott & Karas

[57] ABSTRACT

An electronic, code-operable lock attachment, having a shank adapted to fit, and be fixedly attached to, a standard mortise lock, and having a flange-like rim portion, a housing fixedly attachable to the rim portion of the shank, an actuating shaft passing in an axial direction through the housing and the shank, a bolt-operating arm fixedly mounted on one end of the shaft and adapted, in the mounted state of the electronic lock attachment, to engage the bolt of the mortise lock. The lock attachment also includes a handle fixedly attached to the second end of the shaft. There is also included an electromagnet mounted inside the shank and having a plunger passing through a first hole, being located in the shank, and through a second hole, being located in the bolt-operating arm and retractable, in the excited state, at least from the second hole, the first hole and the second hole being substantially aligned when the lock is in the locked state, and an electronic circuit adapted to activate the electromagnet when enabled by at least the insertion, into the lock attachment, of a code-carrying key.

7 Claims, 3 Drawing Sheets

ELECTRONIC LOCK

BACKGROUND OF THE INVENTION

The present invention relates to a code-operatable electronic lock attachment, in particular to a lock attachment for a standard mortise lock.

The term "attachment" as used herein is not meant to exclude the possibility of manufacturing a mortise lock of which the object of the invention is an integral part.

The acute security consciousness of a population having to cope with a rising crime rate and an increasingly sophisticated criminal element has amongst others produced a large industry dealing primarily with access control at all levels, from military installations to office buildings, and from five-star hotels to road-side motels to private homes.

The classical access-control means, the simple, but easily picked tumbler lock has long been abandoned in favor of the cylinder lock which, though still pickable by expert fingers, is much safer as long as the keys don't fall, even temporarily, into the wrong hands, because nothing is easier than to prepare a perfect copy of such a key. Larger establishments, especially hotels, have therefore started to periodically switch the cylinders of their locks, an expensive procedure if carried out frequently, and a useless one if performed too infrequently.

The next step was the discarding of the mechanical lock and its replacement by an electromagnetically operated one that could be controlled by an electronic circuit activatable by an encodable card plus the personal code of the user to be keyed into a push button unit. The card codes could be easily changed, thus facilitating invalidation of such cards whenever the situation warranted such a step. These locks and their peripherals are, however, very expensive, and their use is justified only in high-level security applications. A less expensive access-control method suitable for office buildings, hotels, and the like, was to retain the mechanical locks and to provide an electro-magnetically operated strike that, when activated by an electronic circuit enabled by a code-bearing card, would release the lock bolt. However, the modifications required, such as the introduction of the strike-operating solenoid, the mounting, on the door frame, of the electronic circuitry, including the card reader, etc. etc., demanded the skill of an expert and were therefore so expensive as to militate against wider use of this basically sound idea.

SUMMARY OF THE INVENTION

It is one of the objects of the present invention to overcome the disadvantages and drawbacks of the prior-art electronic locks and to provide a lock attachment that is not only relatively inexpensive in itself, but that fits standard mortise locks and the mountings of which lock attachment in such a standard lock demands minimal skills only, not requiring any modification of either door panel or door frame.

Thus the present invention achieves by providing an electronic, code-operable lock attachment, comprising:

a shank adapted to fit, and be fixedly attached to, a standard mortise lock, and having a flange-like rim portion;

a housing fixedly attachable to the rim portion of said shank;

an actuating shaft passing in an axial direction through said housing and said shank;

a bolt-operating arm fixedly mounted on one end of said shaft and adapted, in the mounted state of said electronic lock attachment, to engage the bolt of said mortise lock;

handle means fixedly attached to the second end of said shaft and, when turned in the enabled state of said electronic lock attachment, causing said shaft to turn said arm, resulting in the lock bolt being operated;

electromagnetic means mounted inside said shank and having a plunger passing, in the state of rest of said means, through a first hole, being located in said shank, and through a second hole, being located in said bolt-operating arm and retractable, in the excited state of said means, at least from said second hole, said first hole and said second hole being substantially aligned when said lock is in the locked state, and an electronic circuit adapted to activate said electromagnetic means when enabled by at least the insertion, into said lock attachment, of code-carrying key means.

The invention further provides an electronic, code-operatable lock attachment, comprising:

a shank adapted to fit, and be fixedly attached to, a standard mortise lock, and having a flange-like rim portion;

a housing adapted to act as door knob of said lock, provided with a bottom member facing the flange-like rim portion of said shank;

a shaft, rotatably mounted in said shank, one end of which shaft is fixedly attached to said bottom member, said shaft rotating when said housing is rotated;

a bolt-operating arm pivotably mounted on one end face of said shank and adapted, in the mounted state of said electronic lock attachment, to engage the bolt of said mortise lock;

transmission means to transmit the rotary motion of said shaft to said bolt-operating arm;

electromagnetic means mounted inside said housing and having a plunger passing, in the state of rest of said means, through a first hole being located in said bottom member and through a second hole, being located in said flange-like rim portion and retractable in the excited state of said electromagnetic means, at least from said second hole, said first hole and said second hole being substantially aligned when said lock is in the locked state, and an electronic circuit adapted to activate said electromagnetic means when enabled by at least the insertion, into said lock attachment, of code-carrying key means.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
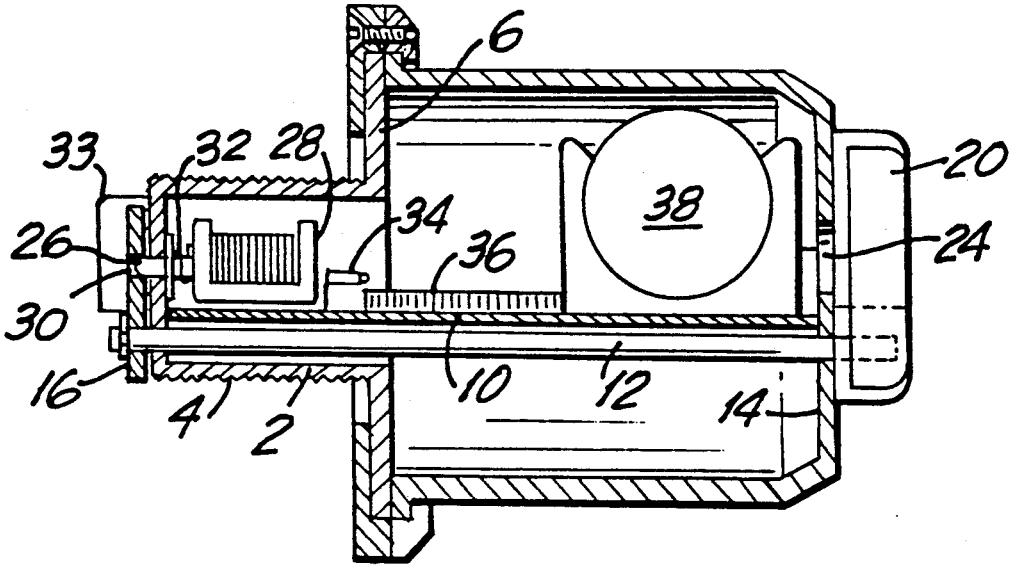
FIG. 1 is a side view, in cross section, of a first embodiment of the lock attachment according to the invention.
Figure 2:
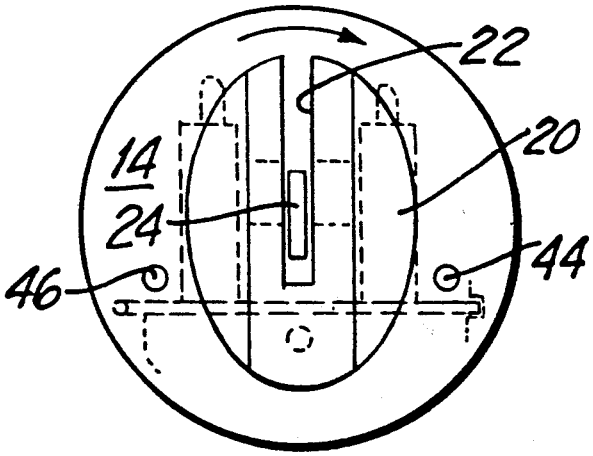
FIG. 2 is a front view of the embodiment of FIG. 1.
Figure 3:
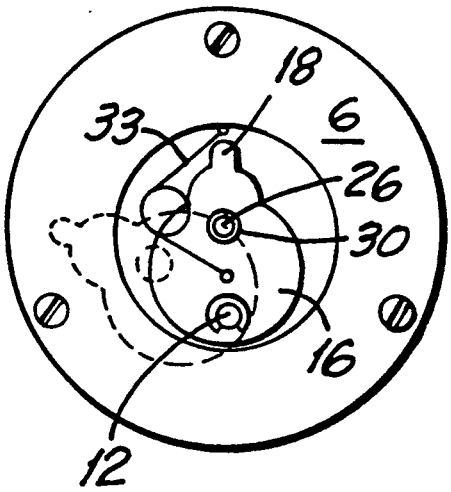
FIG. 3 represents a rear view of the embodiment of FIG. 1.

Referring now to the drawings, there is seen in FIGS. 1 to 3 a hollow shank 2 closed at one end, and provided with an external thread 4 and a flange-like rim 6. The thread 4 fits the internal thread of standard mortise locks into which the mechanical cylinder of such locks is screwed.

Figure 4:
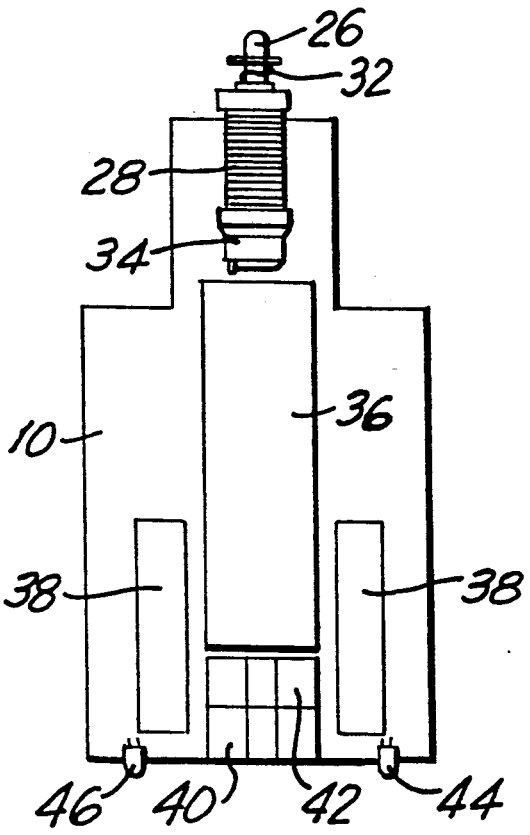
FIG. 4 is a schematic view of the card on which the circuitry compounds are mounted.

To the flange-like rim 6 is fixedly attached a cup-like housing 8 which, together with the hollow of the shank 2, accommodates card 10 on which are mounted the components of the electronic circuitry schematically represented in FIG. 4 and to be detailed further below.

Passing through the unit comprised of shank 2 and housing 8 in an axial direction, there is seen a shaft 12 rotatably mounted, near one of its ends, in the closed end of the shank 2, and near the other one of its ends, in the face portion 14 of the housing 8. To the shank-side end of the shaft 12 is fixedly attached a bolt-operating arm 16, the extreme end 18 of which, when rotated, is adapted to engage, and move, the lock bolt (not shown). To the housing-side end of the shaft 12 is fixedly attached a handle or knob 20 by means of which the arm 16 can be made to rotate—when electronically and electromagnetically released to do so in a manner to be explained further below—in order to move the lock bolt.

Knob 20 is provided with a slot 22 (FIG. 2), exposing a window-like opening 24 in the housing face 14, through which, as will be explained further below, a plastic key is inserted.

What prevents the bolt-operating arm 16 from being rotated by the knob 20 without use of the proper key or, indeed, of any key at all, is the plunger 26 of a solenoid 28 fixedly mounted inside the shank 2 on the card 10, which plunger 26, in the "O" state of the solenoid 28, i.e., in the state of rest of the lock, passes through a hole in the closed end of the shank 2, into an appropriately sized hole 30 in the bolt-operating arm 16, thus effectively immobilizing the arm 16. Only when, in a way to be explained further below, the plunger 26 is withdrawn (against the restoring force of a spring 32), it is possible to rotate the arm 16 and, thus, retract the bolt, by turning the knob 20. When, after the door has been opened, the knob 20 is released, a torsion spring 33 (FIG. 3) pulls the arm 16 back from the tilted into the upright position, until plunger 26 snaps into the hole 30, again immobilizing arm 16.

Apart from the solenoid 28, there are mounted on the card 10 also the rest of the circuit components, such as a microswitch 34, a microprocessor 36, lithium batteries 38, two detectors 40 and 42 and two LED's 44 (red) and 46 (green). The functions of these components will be briefly touched upon further below. The card 10 itself is mounted inside the housing 8.

Figure 5:
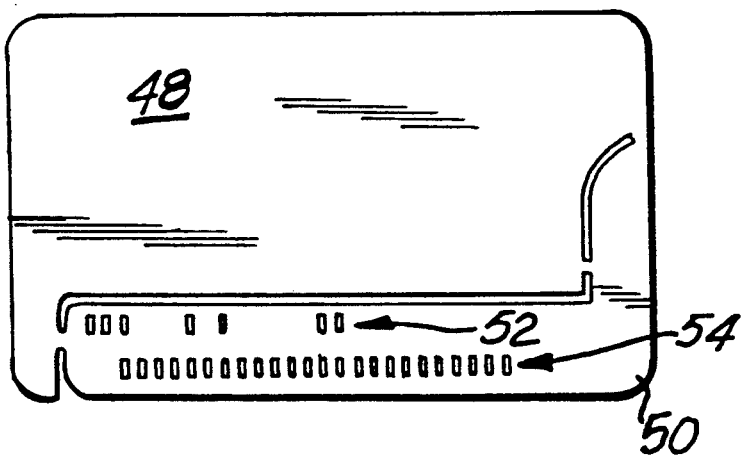
FIG. 5 shows the plastic card incorporating the punched tear-out key.

The key for the electronic lock attachment according to the invention is shown in FIG. 5 and is advantageously delivered to the user, e.g. a guest in a hotel, in the form of a plastic card 48 with the tear-out key 50 attached. In this particular embodiment, the code is of the punched-hole type and is represented by the upper row 52 of punched holes. The lower row 54 serves for synchronization during the actual code reading stage (see below).

The manipulations involved in opening the lock are as follows:

1) The key 50 is pushed through the window 24 into the lock. At the end of the insertion stroke, the tip of the key 50 encounters, and closes, the normally open microswitch 34, which activates the microprocessor 36. Closing of the microswitch 34, i.e., activation of the microprocessor 36, is indicated by a steady red light from the LED 44.
2) The key 50 is now withdrawn. It is during this pull-out stage that the code represented by the number and location of the punch holes in row 52 is read and compared with the programmed code. Detector 40 reads row 52, while detector 42 provides the reference or synchronization required to relate the sequence of holes in row 52 to the code as programmed.
3) Successful completion of code verification is indicated by the green LED 46 flashing, as well as, optionally, by an acoustic signal. The solenoid 28 is excited for some seconds, the plunger 26 is withdrawn from hole 30, and during this period, the knob 20 can be turned to open the door.

Non-verification of the code occasioned, for instance, by the use of a wrong key, causes the red LED 44 to flash.

Figure 6:
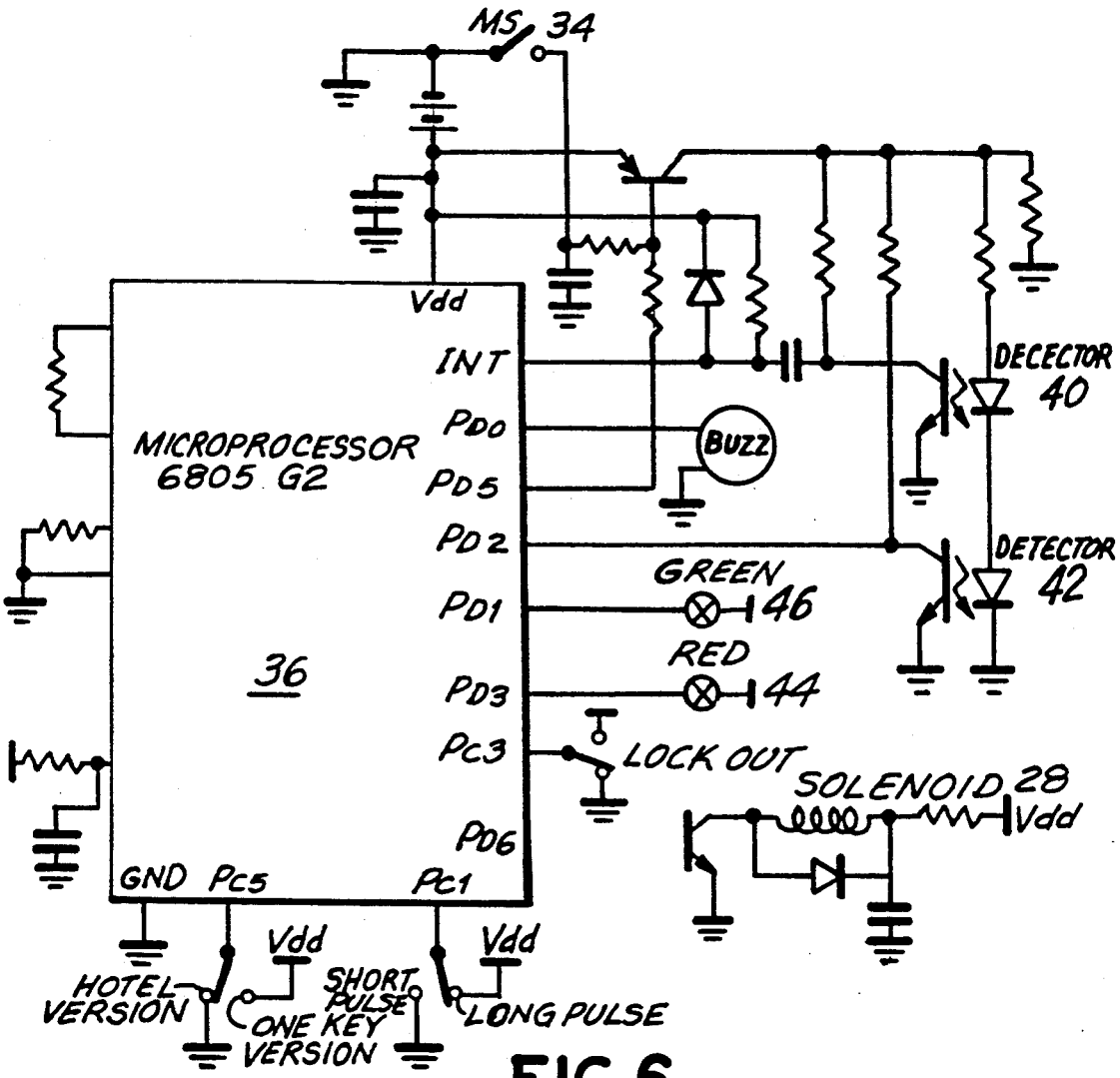
FIG. 6 is a schematic circuit diagram of the electronics of the lock attachment according to the invention.

The circuit diagram of the electronic lock attachment according to the invention is shown in FIG. 6. It is seen that the circuit can be set to "Hotel Version" which recognises the use of master keys of various levels (maid, zone, manager, etc.) and is easily reprogrammed, so that a key once used by a guest will never be used again after departure of this guest. Another hotel feature available is "Maid lockout", which prevents entry even with proper service-level master key. Key codes are allotted by a computer which controls a card punching device. Allotted codes are printed out by a printer for the record. By switching over to the "One-key version" suitable for small offices or private dwellings, the above features are eliminated. The "green flash" interval, during which the knob 20 can be turned to open the door can be made "short" (about one second), or "long" (about four seconds). The "short" pulse increases battery life, but demands faster responses from the user.

Figure 7:
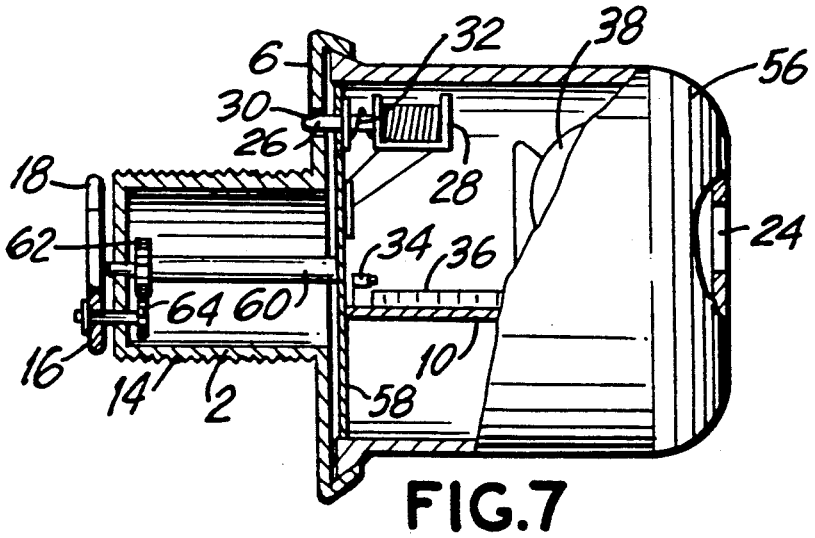
FIG. 7 shows a cross sectional side view of a second embodiment of the lock attachment.

Another embodiment of the invention is shown in FIG. 7. Here what was previously the stationary housing 8, has now the function and the shape of a door knob 56. The hollow knob 56 has a base 58 to which are attached both the solenoid 28 and the circuit card 10. The solenoid plunger 26 now indexes in a hole 30 located in the flange-like rim 6 of the shank 2. The rotary movement of the door knob 56 is transmitted to the bolt-operating arm 16 via a short shaft 60 and a pair of gears 62, 64. The arm restoring spring 33 is not shown.

While in the embodiments shown the code is of the punched-hole type, other types of encoding may be used as well, for instance magnetic encoding.

The lock attachment according to the invention may also include a state-of-battery indicator.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An electronic, code-operable lock attachment, comprising:

a shank adapted to fit and be fixedly attached to a standard mortise lock, and having a flange-like rim portion;

a housing fixedly attachable to the rim portion of said shank;

a rotatable actuating shaft passing in an axial direction through said housing and said shank;

a bolt-operating arm fixedly mounted on a first end of said shaft and being rotatable thereby and being adapted, in a mounted state of the electronic lock attachment, to engage a lock bolt of the mortise lock;

turnable handle means fixedly attached to a second end of said shaft and, when turned in an enabled state of the electronic lock attachment, causing said shaft to rotate said arm between two end positions to move the lock bolt of the mortise lock between a locked state and an unlocked state;

excitable electromagnetic means mounted inside said shank;

said shank having a first through hole, said bolt-operating arm having a second through hole formed such that it becomes substantially axially aligned with said first hole when said arm is in one of said end positions;

said electromagnetic means having a plunger passing, in a non-excited state of said electromagnetic means, through said first through hole and through said second hole so as to immobilize said arm and, in an excited state of said electromagnetic means, retracting at least from said second hole, said first through hole and said second through hole being substantially aligned when said lock is in the locked state;

recess means in said housing for receiving a code-carrying key means; and an electronic circuit adapted to activate said electromagnetic means by an insertion into said recess means of the code-carrying key means.

2. The lock attachment as claimed in claim 1, wherein said electromagnetic means is a solenoid having said plunger which is spring-biased towards an extended position thereof, in which it passes through said first and said second through hole.

3. The lock attachment as claimed in claim 1, and further comprising spring means biasing said bolt-operating arm towards the end position in which said first and said second through hole are substantially aligned.

4. An electronic, code-operable lock attachment, comprising:

a shank adapted to fit and be fixedly attached to a standard mortise lock, and having a flange-like rim portion;

a rotatable housing adapted to act as a door knob of the lock and provided with a base member facing said flange-like rim portion of said shank;

a shaft rotatably mounted in said shank, one end of said shaft being fixedly attached to said base to be rotated upon rotation of said housing;

a bolt-operating arm pivotably mounted on one end face of said shank and adapted, in a mounted state of the electronic lock attachment, to engage a lock bolt of the mortise lock;

transmission means positioned between said shaft and said bolt-operating arm to transmit a rotary motion of said shaft to said bolt-operating arm to rotate said arm between two end positions so as to move the lock bolt of the mortise lock between a locked state and an unlocked state;

said base member having a first through hole, said flange-like rim portion of said shank having a second through hole formed such that it becomes substantially axially aligned with said first hole when said arm is in one of said end positions;

excitable electromagnetic means mounted inside said housing and having a plunger passing, in a non-excited state of said electromagnetic means, through said first through hole and through said second through hole and, in an excited state of said electromagnetic means, retracting at least from said second through hole, said first hole and said second hole being substantially aligned when said lock is in the locked state;

recess means in said housing for receiving a code-carrying key means; and an electronic circuit adapted to activate said electromagnetic means by an insertion into said recess means, of the code-carrying key means.

5. The lock attachment as claimed in claim 4, wherein said electromagnetic means is a solenoid having the plunger which is spring-biased toward an extended position, in which it passes through said first and second through hole.

6. The lock attachment as claimed in claim 4, further comprising spring means biasing said bolt-operating arm towards the position in which said first and said second through holes are substantially aligned.

7. The lock attachment as claimed in claim 4, wherein said transmission means includes a pair of meshing gear wheels.

* * * * *